US005150719A

United States Patent [19]

Adkins et al.

[11] Patent Number: 5,150,719

[45] Date of Patent: Sep. 29, 1992

[54] APPARATUS AND METHOD FOR REMOVING TOBACCO SHREDS FROM A CIGARETTE FILTER

[75] Inventors: Wayne B. Adkins, New Kent; Jose I. Roncero, Richmond, both of Va.

[73] Assignee: Philip Morris Incorporated, New York, N.Y.

[21] Appl. No.: 657,523

[22] Filed: Feb. 19, 1991

[51] Int. Cl.[5] ..... A24C 5/36

[52] U.S. Cl. ..... 131/96

[58] Field of Search ..... 131/96; 209/133, 136, 209/644

[56] References Cited

U.S. PATENT DOCUMENTS 2,815,029 12/1957 Exner .
2,976,872 2/1961 Morphet et al. .
3,026,880 3/1962 Perrin .
3,103,222 9/1963 Di Ianni .
3,160,161 12/1964 Sandman .
3,224,451 12/1965 Dearsley .
3,233,613 2/1966 Korber et al. .
3,366,125 1/1968 Jackson .
3,577,999 5/1971 Pinkham .
3,757,799 9/1973 Di Ianni et al. .
4,278,100 7/1981 Thatcher .
4,485,827 12/1984 Komossa et al. .
4,763,673 8/1988 Barnes et al. .

*Primary Examiner*—V. Millin
*Assistant Examiner*—Lynne A. Reichard
*Attorney, Agent, or Firm*—Ronald A. Krasnow

[57] ABSTRACT

An automated method and apparatus for removing tobacco shreds from the end of a smoking article filter severed from a tobacco containing smoking article, such as a cigarette. A mechanical arm of a robot, having opposing gripping members, is used to grip and insert the filter into the deshredding apparatus whereupon a deshredding tool is rotated to contact, and a stream of high-pressure air is simultaneously directed at, any tobacco shreds remaining in the tobacco end of the severed filter portion. An exhaust removes the loosened tobacco shreds. The robot then removes the filter from the apparatus. The filter is then ready to be subjected to characterization tests.

28 Claims, 1 Drawing Sheet

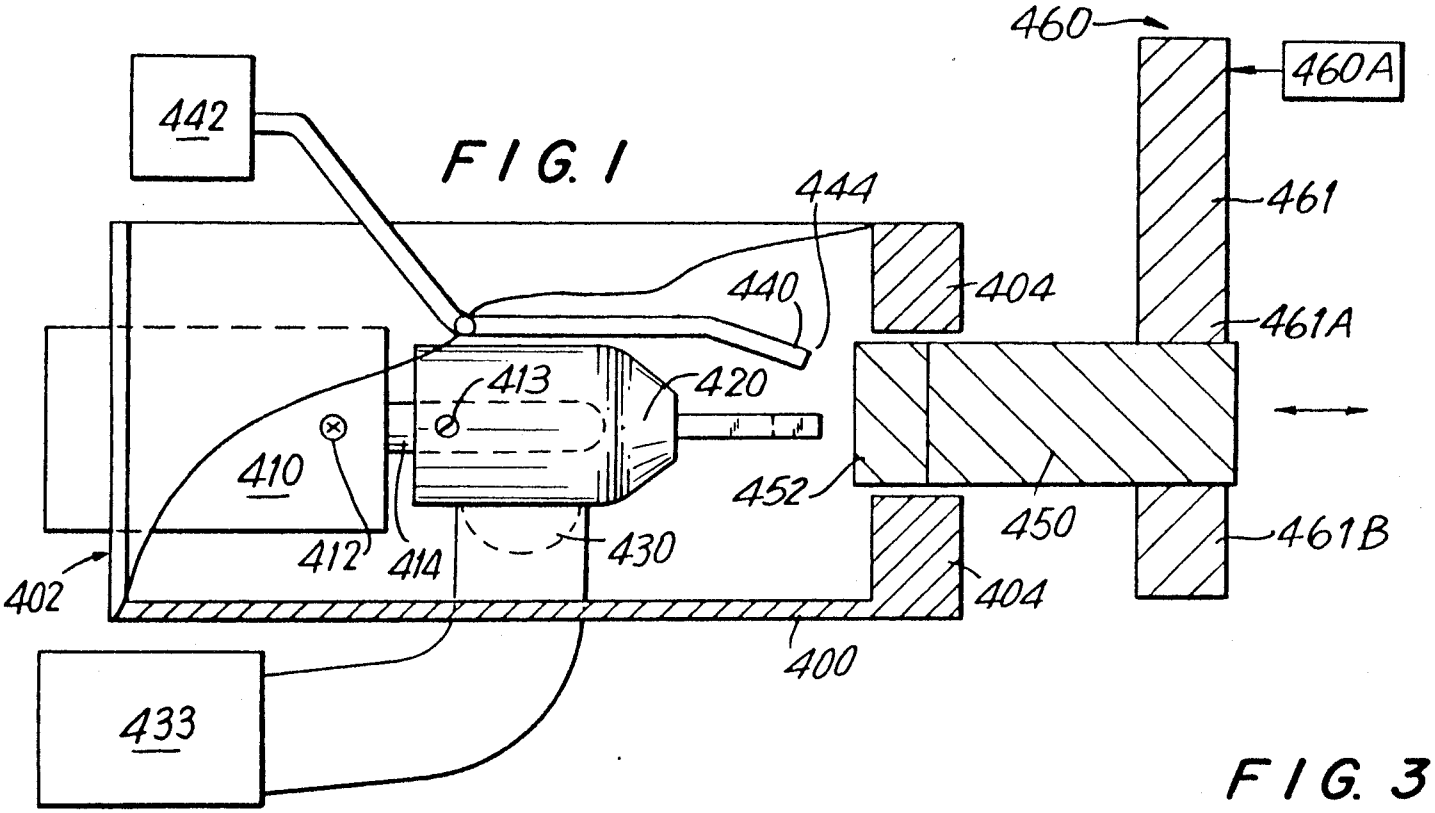
FIG. 1
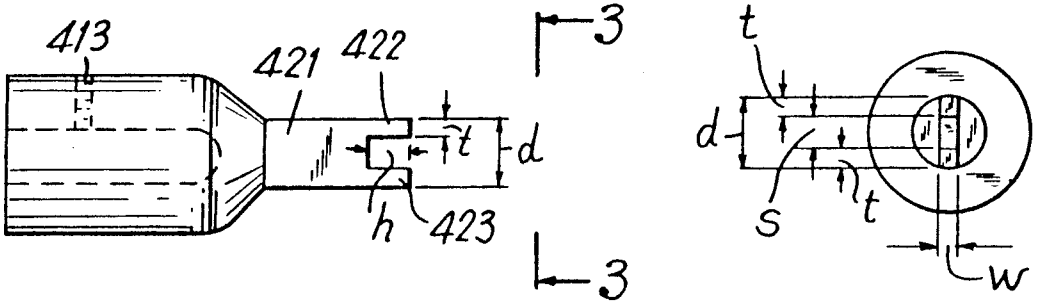
FIG. 2
FIG. 3

APPARATUS AND METHOD FOR REMOVING TOBACCO SHREDS FROM A CIGARETTE FILTER

BACKGROUND OF THE INVENTION

This invention relates to a method and apparatus for removing tobacco shreds from the end of a filter portion of a tobacco-containing smoking article after the filter has been severed from the tobacco body.

It is common practice to perform various tests on commercial and experimental smoking articles and their component parts following assembly. These tests include measuring the physical characteristics of the article and component parts. More specifically, a plurality of like smoking articles are subjected to one or more tests corresponding to one or more specific properties to evaluate the uniformity of the measured property or properties from article to article and to obtain statistical data regarding the mean characteristics of like articles. Different groups of like articles are typically subjected to the same series of tests under conditions that permit comparing the statistical characteristics of different like articles and different groups of like articles.

Such tests are performed on the filter portion of a smoking article. To conduct these tests, the filter typically has to be removed from the smoking article body. Various techniques have been used for this filter removal process. Most of these techniques employ a razor blade where the cigarette body is separated from the filter a few millimeters above the filter. The cutting is generally performed by hand or with the aid of an apparatus which employs a razor blade on the end of a pushrod.

A problem with severing the filter from the tobacco portion is that there is a tendency for a small amount of individual tobacco shreds to stick to the end of the filter because of the porous surface morphology of the filter. In addition, a length of cigarette paper overwrapping the article may extend from the end of the filter material a sufficient distance to retain a plug of tobacco shreds after the cutting process. The tobacco shreds must, however, be removed from the tobacco end of the filter material (referred to herein as "deshredding") prior to performing any characterization tests on the filter to obtain accurate and reproducible test data.

One technique for removing the tobacco shreds from the end of the filter comprises manually shaking, tapping or agitating the filter so that the shreds will loosen and fall away from the filter. Another technique is to remove manually the shreds with a finger or a small tool.

One problem with the prior known techniques is that they are manual operations which are not adaptable to an automated deshredding technique or an automatic workstation for removing shreds for characterization tests on smoking articles.

It is, therefore, an object of this invention to provide for an improved method and apparatus for removing tobacco shreds from the end of a filter portion of a smoking article that has been cut away from a tobacco body of the article.

It is another object of this invention to provide for removing tobacco shreds from the end of a filter with a process and apparatus that can be incorporated into an automated facility for testing the filters.

SUMMARY OF THE INVENTION

In accordance with the present invention, an apparatus and method for removing tobacco shreds from the end of a severed filter portion of a smoking article is provided. Broadly, the invention concerns a workstation having a deshredding area comprising means for positioning a severed filter portion in a selected location to present the tobacco end side of the filter to the deshredding area, a deshredding tool for contacting and loosening tobacco shreds in the severed filter portion in response to the presented end being in the selected location, and means for producing a stream of gas, e.g., air, directed at the presenting end of the severed filter portion at the selected location for loosening and removing tobacco shreds in response to the presented end being at the selected location. One preferred embodiment further includes means for exhausting tobacco shreds from the deshredding area. In another preferred embodiment, the positioning means comprises a means for gripping the severed filter portion at a first location and maneuvering the tobacco end of the filter to a second location so that the filter end is presented to the deshredding area.

One embodiment of the deshredding tool comprises a fork having two prongs and means for rotating the fork at a selected speed. The spacing between the tip of the tool and the selected location is chosen so that the tool does not contact the filter material. Preferably the tool is relatively moved to within 1 to 2 mm of the filter material in the severed filter portion, and rotates at a rate of from 3000 to 4000 rpm, preferably 3600 rpm. Thus, the rotating tool will contact tobacco shreds that are not or cannot be loosened and removed by the gas stream to loosen such shreds for removal by the gas stream and the exhausting means.

In an alternative embodiment, the means for positioning the severed filter portion comprises a means for moving the deshredding tool from one location, at which the tool is not rotating, to a location that is proximate to the selected location, at which the tool is rotating.

In one embodiment, the gripping means grips the filter while the filter is stationary at the first location. In this first location the filter may or may not still be attached to the smoking article body. If it is, the filter must first be severed from the tobacco body prior to maneuvering the filter to the second location. The filter may be gripped, for example, at the very end length of the filter section while it is at rest in a holding device or against a stop at the terminus of a chute for feeding articles one at a time. The severing process and apparatus do not form any part of this invention. Further, the gripping means preferably continues to grip the filter for delivery to subsequent workstations after the filter has been deshredded.

In a preferred embodiment, the gripping and maneuvering means comprises a robot having an arm at the end of which are a pair of opposing members for gripping a smoking article filter about its circumference. The arm is provided with a sufficient range of motion to manipulate the gripped filter from a first location to the selected location for deshredding and, if necessary, to a cutting apparatus where the tobacco body is removed from the filter. As the severed filter portion is maneuvered to the selected location, the deshredding apparatus is actuated, i.e., the tool is actuated to be rotating at its operating speed for deshredding, the gas stream begins to flow and the exhausting means begins to exhaust to facilitate removal of tobacco shreds from the tobacco end of the filter material. The actuation of these devices may be initiated by, for example, instructions from the robot (or a computer controlling the robot) in response to the robot maneuvering a filter portion in proximity to the selected area or a proximity sensor in or near the deshredding area for detecting the insertion of a filter. The robot arm, which continues to hold the filter during the deshredding operation, then extracts the filter from the apparatus and maneuvers the filter to an appropriate test station.

In accordance with a preferred embodiment, a microprocessor device is used to control the operation of the robot to grip a smoking article filter, to maneuver it into the deshredding apparatus to the selected location, and to activate the deshredding apparatus. After the deshredding operation, the computer may then direct the robot to remove the filter from the apparatus and manipulate it to an appropriate test station and deactivate the deshredding apparatus.

Another embodiment of the present invention is directed to a method for removing shreds from the end of a smoking article filter automatically. One such a method comprises the steps of maneuvering a severed filter portion to a selected location in a deshredding area, directing a stream of gas at the tobacco side of the filter portion to loosen and remove tobacco shreds, providing a deshredding tool and placing that tool into contact with any tobacco shreds to loosen said shreds, and, optionally, exhausting the loosened tobacco shreds from the deshredding area.

The present invention is preferably incorporated as part of an automatic test station for conducting a series of tests on smoking articles and their constituent parts, for example, measuring certain characteristics of the finished smoking article such as a conventional cigarette followed by severing the filter portion from the article and performing one or more tests on the filter portion.

DESCRIPTION OF THE DRAWINGS

Further features of the invention, its nature and various advantages will be more apparent from the accompanying drawings and the following detailed description of the invention, in which like reference numerals refer to like elements, and in which:

FIG. 1 is a partial sectional view of the deshredder apparatus in accordance with an embodiment of the present invention;

FIG. 2 is side view of the deshredder tool of FIG. 1; and

FIG. 3 is an end view taken along line 3—3 of FIG. 2.

DETAILED DESCRIPTION OF THE INVENTION

Referring to FIGS. 1-3, an embodiment of the present invention includes housing 400, deshredder motor 410, deshredder tool 420, vacuum port 430, and air stream conduit 440. Deshredder motor 410, which is mounted in end 402 of housing 400, is used to rotate deshredder tool 420 at a selected speed, preferably 3600 rpm. Robot 460 inserts smoking article filter 450 (shown in cross section) in end 404 of housing 400 in axial alignment with motor 410 and tool 420. End 404 has an aperture for receiving filter 450. The aperture dimension is preferably selected to receive smoking article filter portions having a circumference in a range of circumferences, e.g., 22-25 mm, and to permit annular air flow into housing 400 when filter portion 450 is inserted. Preferred aperture dimensions are from about 9 to about 10 mm in diameter.

Presenting end 452 is preferably brought within 2 mm of the tip of deshredder tool 420. A stream of high pressure air from source 442 is blown onto presenting end 452 of filter 450 through conduit 440. Rotating deshredder tool 420 may contact the tobacco shreds attached to filter 450 that are not loosened by the stream of air, to loosen those shreds not removed by the air stream. Preferably, vacuum port 430 also is provided to exhaust to vacuum 433 any loosened tobacco shreds that have become detached from the end of the filter by the air stream, deshredder tool 420 or both.

Deshredder motor 410 is held in housing 400 by way of screws 412. Attached to the end of the deshredder motor shaft 414 is deshredder tool 420, which is held in place by way of set screw 413. Deshredder tool 420 can be made of a hard material, but most preferably it is made out of a hard steel or aluminum alloy, for example, having a black oxide finish.

Referring to FIGS. 2 and 3, tool 420 preferably has two prongs 422 and 423 extending from tip 421 such that tip 421 has a rectangular cross section of width w and length d. Length d corresponds to the diameter in which tip 421 rotates which is less than the corresponding diameter of the filter portion, for example, in the range of 0.2 to 0.23 inches, preferably 0.2 inches. Each prong 422 and 423 preferably is a four sided structure of dimension w, preferably about 0.045 inches, by dimension t, preferably about 0.053 inches, such that each prong projects a distance h, preferably about 0.15 inches, from the unmilled rectangular body of tip 421 of tool 420. Prongs 422 and 423 are preferably located at the periphery of distance d, separated by space s of about 0.095 inches.

In accordance with an alternate embodiment, deshredder tool 420 may have an alternate motion, for example, a circular back-and-forth motion where the tool rotates half of a revolution before it reverses direction. Tool 420 also may have an alternate tip configuration, for example, more than two prongs, prongs at angles relative to one another, a hook, a scythe, a flat loop, or a spiral or helical section.

Adjacent deshredder tool 420 is conduit 440 which is preferably simply formed of standard ⅛th inch outer diameter copper tubing having an inner diameter of 0.07 inch. Such tubing is malleable and conduit 440 can be bent, as necessary, to place tip 444 in close proximity to the selected location and deshredder tool 420 so that tip 444 is directed at presenting end 452 of filter 450. Tip 444 is preferably formed by cutting tube 440 transversely, but may also be provided with a configured shape to provide a nozzle. Source 442 is connected to conduit 440 and provides an air stream, preferably a high pressure air stream in the range from between 10 to 100 pounds per square inch (psi), more preferably in the range of 10 to 40 psi, even more preferably in the range from 15 to 25 psi, and most preferably 20 psi. Source 442 preferably has an on condition and an off condition for regulating air flow depending upon whether or not a filter portion is in position or being brought into position to be deshredded. In accordance with the invention, other types of inert high-pressure gas, for example, nitrogen, and gas jet delivery systems could be used.

Vacuum source 433 is attached to vacuum port 430 of housing 400 by conduit 432. Vacuum source 433 is preferably a 0.5" diameter and has a suction in the range of 15 to 25 in-Hg; sufficient to exhaust all of the gas provided through conduit 400 and maintain a negative pressure inside housing 440. Vacuum source 433 serves to entrain and to exhaust tobacco shreds which become detached from filter 450 and has an on condition and an off condition depending upon whether or not a filter portion is in position or being brought into position to be deshredded.

In operation, severed filter portion 450 is gripped between opposing members 461A and 461B of robot 460 at a first location, and is maneuvered axially into end 404 of housing 400. Robot 460 positions filter 450 to a predetermined selected location corresponding to placing presenting tobacco end 452 of the filter 450 into the deshredding area. Immediately prior to insertion, however, a computer (not shown in figures) is used to activate deshredder motor 410 to cause tool 420 to rotate, air source 442 to commence air flow through conduit 440, and vacuum source 433 to commence exhausting air through port 430, so that these elements are fully operative when filter 450 is in the selected location. Preferably, vacuum 433 is turned on and off at same time as motor 410 and airjet 442. Following such activation, robot 460 brings the end of filter 450 to within a few mm from deshredder tool 420, for example, 1.5 to 2.5 mm, more preferably 2 mm. As this occurs, presenting end 452 becomes subjected to the gas flow which will begin to loosen and remove tobacco shreds even before end 452 is at the selected location.

Robot 460 holds filter 450 in the selected position for a period of 1 to 4 seconds, more preferably 2 seconds. At the end of this period, the computer deactivates deshredder motor 410, air source 442, and vacuum 433, and robot 460 removes the deshredded filter 450 from the deshredder housing 400. At this stage the filter is ready to undergo the various tests which are performed on it. Alternately, tool 420, source 442 and vacuum 433 may be continuously operating.

Robot 460 is preferably a model Movemaster II, manufactured by Mitsubishi, Tokyo, Japan, available from Perkin-Elmer, Norwalk, Conn., under model No. 9000, and is programmable. Robot 460 has a moveable arm 461 comprised of first member 461A and second member 461B that move in opposition to each other to grip filter 450 at a first selected location, for example, at the mouth end or midpoint of the filter segment. The arm 461 is moveable and thus is capable of inserting the filter 450 into housing 400 to a desired depth, as shown by the double-sided arrow in FIG. 1. The exact sequence of movements of the arm 461 may be stored in the robot 460. Such programming may also include identifying a plurality of first like filter portions to be tested in succession, followed by identifying a second plurality of second like filter portions to be tested in succession subsequent to the first like filter portions, so that the deshredding operation can be conducted automatically in an unattended mode.

Depending on the amount of tobacco shreds to be removed, in the selected location tool 420 may be initially immersed in a relatively thick plug of tobacco shreds thereby to loosen the shreds, or may not be in contact with any shreds. The distance between the tip of tool 420 and the end of filter 450 is selected, based in part on the diameter of the filter portion, so that if the tool does not contact any shreds in area 452, the air flow has either removed them or is sufficient to remove them during the time period the filter is maintained at the selected location, and there is an insufficient force to retain the shreds on the filter end to withstand both the air flow and tool 420. In operation, it has been found that the air stream removes most of the tobacco and that the tool is most useful when the presenting portion contains a length of cigarette paper enclosing a plug of tobacco shreds in excess of 2 mm. Thus, using the deshredding tool to remove all but the last 2 mm of shreds provides for the air stream to remove the remaining shreds and complete the deshredding operation. In addition, the deshredding tool may provide a turbulent air stream that facilitates loosening the shreds.

Also, robot 460 fingers 461A and 461B are adapted to grip a smoking article without crushing the smoking article. For example, the opposing members may be rectangular structures disposed in parallel having right angle notches cut on their inner opposing surfaces (not shown). In gripping a smoking article, the members may be moved towards each other so that notches form a parallelogram surrounding the article without crushing the article. Those gripping surfaces also may be provided with a mildly abrasive coating, for example, a fine grade emery paper (240 grit) for gripping the article without slippage.

Alternately robot 460 may be controlled by a microprocessor device 460A having software and instructions for controlling the movement of robot 460, opposing members 461A and 461B, deshredder motor 410, air source 442 and vacuum source 433.

One skilled in the art will appreciate that the present invention can be practiced by other than the described embodiments, which are presented for purposes of illustration and not of limitation, and the present invention is limited only by the claims which follow.

We claim:

1. Apparatus for removing tobacco shreds from an end of a filter material in a severed filter portion of a smoking article, comprising:

means for gripping the severed filter portion and means for maneuvering the severed filter portion to a selected location so that a filter material tobacco end is presented to a deshredding area in the selected location;

means for maintaining the filter portion at the selected location for a period of time;

a deshredder tool for contacting and loosening tobacco shreds, said tool being located proximate to the selected location so that the filter material is a preselected distance from said tool; and means for directing a stream of gas at the selected location to loosen and remove tobacco shreds.

2. The apparatus of claim 1 further comprising means for exhausting loosened tobacco shreds from the deshredding area.

3. The apparatus of claim 1, wherein the deshredding tool further comprises a motor having a drive shaft wherein the deshredding tool is secured to the drive shaft and rotated.

4. The apparatus of claim 3, wherein the tool is rotated at a rate selected from between 100 to 10,000 revolutions per minute.

5. The apparatus of claim 4, wherein the tool is rotated at a rate selected from between 3000 to 4200 revolutions per minute.

6. The apparatus of claim 1, wherein the means for directing a gas stream further comprises:

a supply of gas; and a conduit connected to the gas supply for providing a gas flow at a pressure selected in a range from between 10 to 100 pounds per square inch.

7. The apparatus of claim 6, wherein the pressure is selected in a range from between 15 and 25 pounds per square inch.

8. The apparatus of claim 1, wherein the selected location further comprises placing the filter material a distance from the deshredding tool selected from the range between 1.0 and 2.5 mm.

9. The apparatus of claim 2, wherein the exhausting means further comprises a vacuum and an exhaust flow path that entrains tobacco shreds loosened from the severed filter portion.

10. The apparatus of claim 1, wherein the maneuvering means further comprises a robot having a movable arm and a first member and a second member in opposition for gripping therebetween the filter, and a microprocessor means for controlling the movement of the robot arm and first and second members.

11. The apparatus of claim 3 further comprising means for controlling the deshredding tool so that the tool is rotating as the filter portion is maneuvered to and maintained at the selected location and not rotating otherwise.

12. The apparatus of claim 6 further comprising means for controlling the gas stream means for providing a gas stream as a filter portion is being maneuvered to and maintained at the selected location and for not providing a gas stream otherwise.

13. The apparatus of claim 9 further comprising means for controlling the exhausting means for providing an exhaust flow path as the filter portion is maneuvered to and maintained at the selected location and not providing a flow path otherwise.

14. The apparatus of claim 1 wherein the time period is selected from the range of between 1 and 3 seconds.

15. A method for removing tobacco shreds from an end of a filter material of a severed filter portion of a smoking article comprising:

gripping the severed filter portion and maneuvering the severed filter portion to a selected location so that a filter material tobacco end is presented to a deshredding area in the selected location;

maintaining the severed filter portion at the selected location for a period of time;

rotating a deshredding tool for contacting and loosening any tobacco shreds when the severed filter portion is at the selected location with the filter material a preselected distance from said tool; and directing a stream of gas at the presented end for loosening and removing any loosened tobacco shreds when the severed filter portion is at the selected location.

16. The method of claim 15 further comprising:

exhausting loosened tobacco shreds from the deshredding area.

17. The method of claim 15 wherein rotating the deshredding tool further comprises providing a motor having a drive shaft, securing the deshredding tool for rotation about the drive shaft, and operating the motor to rotate the tool.

18. The method of claim 17, wherein operating the motor further comprise providing the drive shaft with a speed selected from between 100 to 10,000 revolutions per minute.

19. The method of claim 18, further comprises providing the drive shaft with a speed selected from between 3000 to 4200 revolutions per minute.

20. The method of claim 15, wherein directing the stream of gas further comprises:

providing a gas supply;

delivering gas from the supply to the deshredding area through a conduit; and providing a flow of the gas in the deshredding area at a pressure selected in a range of from between 10 to 100 pounds per square inch.

21. The method of claim 20, further comprising providing a flow of the gas at a pressure selected in a range of from between 15 and 25 pounds per square inch.

22. The method of claim 15, wherein maneuvering the severed filter portion to the selected location further comprises placing the filter material a distance from the deshredding tool selected from the range of between 1.0 and 2.5 mm.

23. The method of claim 16, wherein exhausting loosened tobacco shreds from the deshredding area further comprises providing an exhaust flow path for entraining tobacco shreds loosened from the severed filter portion in the deshredding area, and removing the entrained tobacco shreds from the deshredding area through the exhaust flow path using a vacuum source.

24. The method of claim 15, wherein maneuvering the severed filter portion further comprises providing a robot having a movable arm and a first member and a second member in opposition for gripping therebetween the filter, said robot having a microprocessor means for controlling the movement of the robot arm and first and second members.

25. The method of claim 17 further comprising controlling the deshredding tool so that the tool is rotating as the filter portion is maneuvered to and maintained at the selected location and not rotating the tool otherwise.

26. The method of claim 20 wherein providing a flow of gas further comprises providing the gas stream as the filter portion is being maneuvered to and maintained at the selected location and not providing the gas stream otherwise.

27. The method of claim 23 wherein exhausting further comprises providing the exhaust flow path as the filter portion is maneuvered to and maintained at the selected location and not providing the exhaust path otherwise.

28. The method of claim 15 wherein maintaining the severed filter portion further comprises maintaining the severed filter portion for a time selected from the range of between 1 and 3 seconds.

* * * * *